United States Patent [19]

Passovoy

[11] 4,236,354

[45] Dec. 2, 1980

[54] DOOR FRAME ASSEMBLY

[75] Inventor: Alexander E. Passovoy, Oakland, Calif.

[73] Assignee: Anodex, San Ramon, Calif.

[21] Appl. No.: 44,612

[22] Filed: Jun. 1, 1979

[51] Int. Cl.[3] ..... E06B 1/04

[52] U.S. Cl. ..... 49/504

[58] Field of Search ..... 49/501, 504

[56] References Cited

U.S. PATENT DOCUMENTS

| | | | |
|---|---|---|---|
| 3,287,856 | 11/1966 | Passovoy | 49/504 |
| 3,545,135 | 12/1970 | Lieber | 49/505 |
| 3,774,345 | 11/1973 | Cole et al. | 49/504 |
| 3,783,559 | 1/1974 | Yocum et al. | 49/504 |
| 3,964,214 | 6/1976 | Wendt | 49/504 X |
| 4,034,514 | 7/1977 | Cecil | 49/504 |

*Primary Examiner*—Kenneth Downey

*Attorney, Agent, or Firm*—Townsend and Townsend

[57] ABSTRACT

An improved prefabricated door frame construction is disclosed. A frame member is provided which includes a central web spanning the width of the wall and a pair of side flanges which fit over the edges of the wall circumscribing the opening. The web includes a pair of grooves opening in a common transverse direction, one of which is near the center of the web and the other near one edge. Hinge members are provided each having a hinge plate which includes a pair of elongate tongues which engage and mate with the respective grooves of the frame member. Cover plate sections are provided, each of which also has a pair of elongate tongues which engage with the respective grooves. The cover plate sections are cut to fit the gaps between the hinge plates and the ends of the frame member to provide a finished structure.

8 Claims, 4 Drawing Figures

DOOR FRAME ASSEMBLY

BACKGROUND OF THE INVENTION

The present invention relates to door frame assemblies, and in particular to an improved prefabricated door frame construction.

In the construction of interior walls such as those found in offices, and in certain exterior construction, the use of prefabricated metal door frames has become quite common. Such door frames generally consist of extrusions which are provided with slots or countersunk portions so that the hinge plates and strike plates can be conveniently installed. An example of such a door frame construction is depicted in the patent to Cable, U.S. Pat. No. 3,299,592. If the prefabricated door frame does not come from the factory with a provision for the installation of hinge plates and strike plates, the frame assembly must be cut at the construction site so that these items can be installed.

The door frame assemblies such as that described by Cable are not as convenient as desired for several reasons. The door frames must be provided in two models, one for left swinging doors and one for right swinging doors. Also, because the door frame construction determines where the hinges must be located, the hinges must be attached to the door at the construction site, and pre-hinged doors cannot be used. In addition, a separate model of door frame must be provided to accommodate the hinge and strike plate locations of doors of various shapes and sizes because the hinge and strike plate positions are fixed when the frame is fabricated.

In applicant's U.S. Pat. No. 3,287,856, a door frame assembly is depicted in which the hinges and strike plates can be located where desired at the construction site. Spaces between the hinge and strike plates are covered over with cover plate sections to provide an aesthetically pleasing finished construction. The principal difficulty with this type of assembly is that a certain amount of manual labor is still required to fix the hinge and strike plates to the door frame using conventional screw fasteners. Moreover, the construction of this door frame assembly is relatively complex because the cover plates and hinge strike plates are attached to the frame member using discrete connecting mechanisms, each of which must be accommodated by the door frame assembly.

SUMMARY OF THE INVENTION

The present invention provides an improved prefabricated door frame construction. A frame member is provided which includes a central web spanning the width of the wall and a pair of side flanges which fit over the edges of the wall circumscribing the opening. The web includes a pair of grooves opening in a common transverse direction, one of which is near the center of the web and the other near one edge. Hinge members are provided each having a hinge plate which includes a pair of elongate tongues which engage and mate with the respective grooves of the frame member. Cover plate sections are provided, each of which also has a pair of elongate tongues which engage with the respective grooves. The cover plate sections are cut to fit the gaps between the hinge plates and the ends of the frame member.

The hinge plates of the present invention can readily be snapped into engagement with the frame member at any desired position along its length at the construction site. Accordingly, any size or shape door can readily be accommodated, and the hinges can be pre-installed on the doors and the hinge locations on the frame member matched to their locations on the doors. The cover plate sections fill in the spaces between hinge plates, giving the entire construction a smooth, finished look. In addition, strike plates can be employed having pairs of tongues equivalent to those on the hinge plates and cover plate sections so that all portions of the door assembly can be installed on the frame member at the construction site.

The apparatus of the present invention greatly facilitates the installation of door assemblies. The frame members provided by the present invention can be adapted to fit any size or shape door, either left swinging or right swinging. Installation of the hinge plates, strike plate, and cover plates can readily be accomplished at the construction site with the minimum of manual labor. Because of the adaptability of the apparatus, an inventory of different frame models is not necessary.

The novel features which are characteristic of the invention, as to organization and method of operation, together with further objects and advantages thereof, will be better understood from the following description considered in connection with the accompanying drawings which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBDOIMENT

Figure 1:
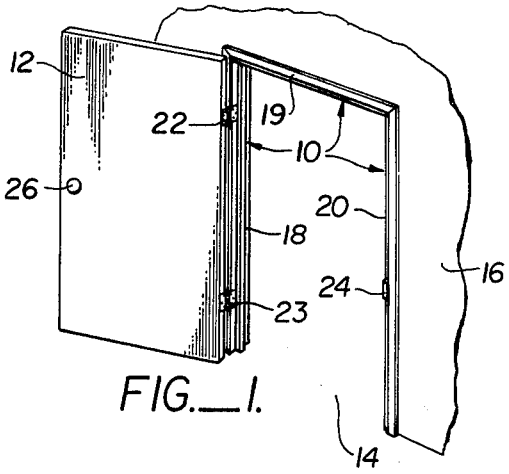
FIG. 1 is a perspective view of a door installed using the door frame assembly of the present invention.

The use of the door frame assembly 10 of the present invention to install a door 12 in the opening 14 formed in a wall 16 is illustrated generally by way reference to FIG. 1. Door frame assembly 10 includes three frame members 18–20 covering the sides and top of door opening 14. A pair of hinges 22, 23 are attached to frame member 18 so that door 12 swings in a clockwise (looking down from the top) direction. This is generally termed a "right swinging" door because it swings to the right of a person opening the door from the outside. A strike plate 24 adapted to engage a latch actuated by knob 26 is attached to frame member 20 at the opposite side of opening 14 from frame member 18.

Figure 4:
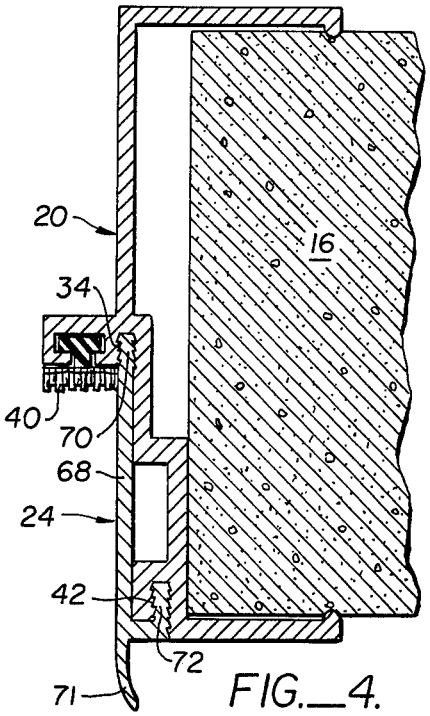
FIG. 4 is a sectional plan view illustrating the installation of a strike plate in the frame assembly of the present invention.
Figure 2:
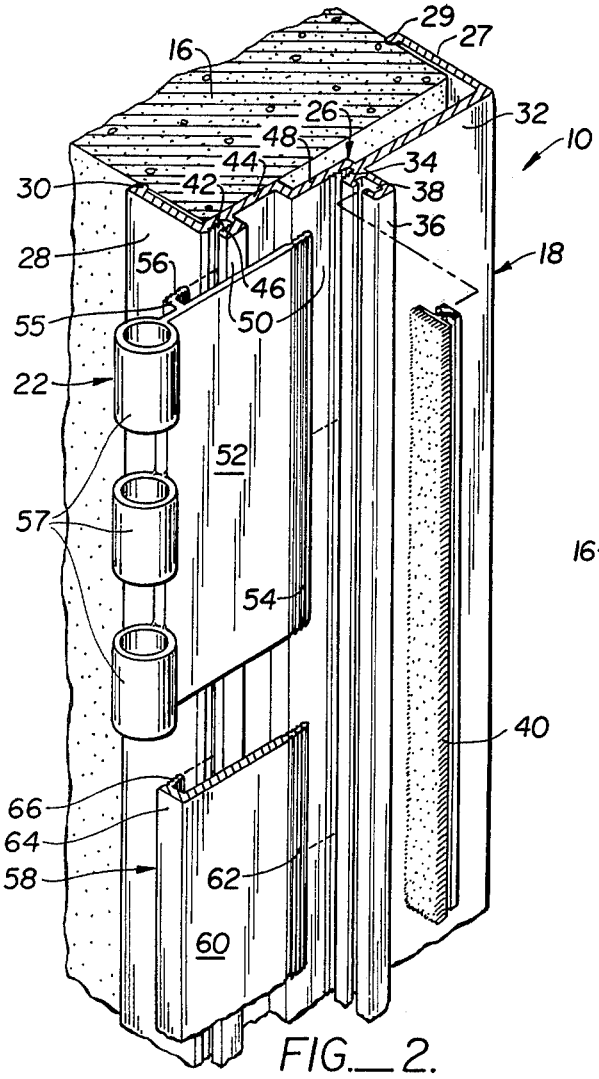
FIG. 2 is a fragmentary, exploded perspective view of the one of the door frame members of the present invention showing installation of the hinges and cover plates.
Figure 3:
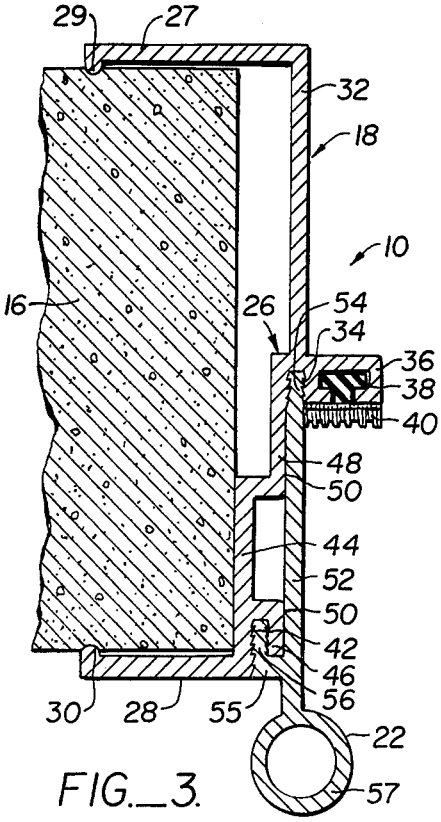
FIG. 3 is a sectional plan view depicting the installation of a hinge plate in the frame member of the present invention.

Door frame assembly 10 is illustrated in more detail by way of reference to FIGS. 2–4 in combination. In FIGS. 2 and 3, door frame member 18 is shown, and in FIG. 4, door frame member 20 is shown, all of the door frame members being identical metal extrusions.

Referring specifically to FIGS. 2 and 3 by way of example, each door frame member such as 18 includes a central web 26 and a pair of side flanges 27, 28. Central web 26 spans the entire width of wall 16 and side flanges 27, 28 extend around the edges of the wall. Each side flange 27, 28 has a projecting bead 29, 30 at its extreme end so that frame member 18 can be installed by simply snapping it over the end of wall 16.

Web 26 includes a substantially planar portion 32 extending from side flange 27 to approximately the center of the web. At the center of web 26, a transversely opening slot 34 is formed which has a serrated configuration. Slot 34 extends along the entire length of frame member 18, and the plane of the slot coincides with the plane of the planar portion 32 of central web 26.

A door stop abuttment 36 is provided at about the center of web 26. Door stop abuttment 36 includes a slot 38 in which a resilient door stop pad 40 can be installed. Slot 38 opens in the same direction of slot 34, i.e., opposite from the planar portion 32 of web 26, dictating that the door always be located from the side of the web opposite from planar portion 32.

Central web 26 of frame member 18 also includes a second transversely opening slot 42 at the side of the web adjacent side flange 28. Slot 42 extends the entire length of frame member 18, and is serrated. The plane of slot 42 is parallel to that of slot 34, but is slightly offset toward wall 16.

Web 26 includes a recessed portion 44 which rests flat against wall 16 and a shoulder 46 which in combination define slot 42. Shoulder 46 together with a connecting portion 48 of web 26 define a planar surface 50 spaced slightly inwardly from the planar portion 32 of the web.

Hinge 22 includes a hinge plate 52 adapted to attach to the frame assembly. Hinge plate 52 has a serrated lateral edge 54 which provides a tongue adapted to project into and engage serrated slot 34 in frame member 18. In addition, projection 55 supports an underlying serrated tongue 56 is provided on hinge plate 52 which engages serrated slot 42. Accordingly, hinge plate 52 can readily be installed on frame member 18 (or frame members 19, 20 since they are identical) at any point along its length after the frame member has been installed by snapping the tongues on the hinge plate into the grooves in the frame members. The thickness of plate 52 and the location of projection 55 are such that when the hinge plate is installed, except for the engagement rings 57 the visual appearance of frame member 18 has mirror symmetry about a plane through its center.

A plurality of cover plate sections such as 58 are also provided as part of the door frame assembly 10 of the present invention. Each cover plate section 58 includes a planar portion 60 having a serrated lateral edge 62 which provides a tongue adapted to engage serrated slot 34 in door frame members 18–20. The thickness of planar portion 60 is the same or nearly the same as that of hinge plates 52. Cover plate section 60 also includes a side flange 64 supporting a projecting serrated tongue 66 adapted to engage slot 42 in frame members 18–20. Accordingly, cover plate sections 58 are attached to the frame members of assembly 10 in the same manner as the hinge plates 52. With cover plate sections 58 installed, grooves 34, 42 are hidden from view and both sides of frame members 18–20 have the same visual appearance. No fastener elements are visible, and the external appearance of the assembly is clean and attractive.

The installation of the strike plate 24 in frame member 20 (which is identical to frame members 18 and 19) is illustrated by way of reference to FIG. 4. Strike plate 24 includes a planar portion 68 having a serrated lateral edge 70 which engages groove 34 in frame member 20 (elements of frame member 20 are given the same reference numerals as corresponding elements in frame member 18). The thickness of planar portion 68 is approximately equal to that of planar portion 60 of cover plate sections 58. Strike plate 24 also includes a curved projection 71 which accommodates the sliding latch member used to keep the door in its closed position. Strike plate 24 has an underlying serrated tongue 72 adapted to engage serrated slot 42. In this fashion, strike plate 24 is attached to frame member 20 in the same fashion as hinge plates 52 and cover plate sections 58.

Frame members 18, 19, 20 can be cut from a single piece of stock extrusion at the construction site to fit the particular door opening 14 in wall 16. Since frame members 18, 19 and 20 are identical, hinges 22, 23 can be installed on any of the frame members at any position along their length to accommodate various size and shape doors, and left and right swinging door applications. Strike plate 24 can similarly be installed where desired. After installation of hinges 22, 23 and strike plate 24, cover plate sections 58 are cut to fit the spaces between the hinges and strike plate and ends of the frame members. The mechanisms by which the cover plate sections 58, hinges 22, 23 and strike plate 24 are attached to frame members 18–20 is completely hidden from view. Both sides of frame members 18–20 with equipment attached appear identical, and the completed assembly forms a finished, aesthetically pleasing structure.

While a preferred embodiment of the present invention has been illustrated in detail, it is apparent that modifications and adaptations of that embodiment will occur to those skilled in the art. However, it is to be expressly understood that such modifications and adaptations are within the spirit and scope of the present invention, as set forth in the following claims.

What is claimed is:

1. Apparatus for providing a door frame in an opening formed in a wall to accommodate a door, said apparatus comprising:

a frame member including a central web adapted to span the width of the wall and a pair of side flanges extending from the lateral edges of the web and adapted to fit over the edges of the wall circumscribing the opening, said web including a planar section extending from one lateral edge to approximately the center of the web and terminating in a first transversely opening groove in the plane of said planar portion, said web further including a second transversely opening groove proximate the second lateral edge and parallel to the first groove but offset therefrom toward the wall;

at least two hinge members each having a planar hinge plate which includes one edge providing a tongue adapted to engage and mate with the first groove in the frame member and a projecting tongue underlying the hinge plate and adapted to engage the second groove in the frame member so that the hinge members can be located where desired and attached to the frame member after installation of the frame member in the opening; and a plurality of cover plate sections each including a generally planar portion having a lateral edge providing a tongue adapted to mate with and engage the first groove in the frame member and a projecting tongue underlying the planar portion and adapted to engage the second groove in the frame member, said cover plate sections adapted to be cut to fit the gaps between hinge plates and the ends of the frame member so that the space between hinge plates is covered to provide an aesthetically pleasing door frame.

2. Apparatus as recited in claim 1 and additionally comprising a strike plate including a generally planar portion having one edge providing a tongue adapted to mate with and engage the first groove in the frame member and a projecting tongue underlying the planar portion and adapted to engage the second groove in the frame member.

3. Apparatus as recited in claim 1 wherein the thickness of the planar hinge plate of each hinge member and the thickness of the planar portion of each cover plate section are approximately the same to provide a continuous smooth surface having a pleasing visual appearance.

4. Apparatus as recited in claim 1 wherin the frame member includes three frame member sections adapted to extend along the two side portions and the top portion of the opening respectively, and wherein the grooves extend along the entire length of said frame member sections.

5. Apparatus as recited in claim 1 wherein the tongues and grooves have complementary serrations so that the hinge members and cover plate sections are firmly engaged with the frame member when the tongues are inserted in the grooves.

6. Apparatus as recited in claim 1 wherein the frame member comprises a metal extrusion.

7. Apparatus as recited in claim 1 wherein the frame member includes a projecting door stop proximate the center of the web of the frame member.

8. Apparatus as recited in claim 1 wherein the visual appearance of the frame member with the hinge members and cover plates installed generally has mirror symmetry about a plane through its center.

* * * * *